US005183411A

United States Patent [19]

Yu

[11] Patent Number: 5,183,411

[45] Date of Patent: Feb. 2, 1993

[54] COAXIAL CABLE

[75] Inventor: Jason Yu, Taipei, Taiwan

[73] Assignee: J. A. L. Taiwan Ltd., Taipei, Taiwan

[21] Appl. No.: 925,195

[22] Filed: Aug. 6, 1992

[51] Int. Cl.[5] ..... H01R 17/04

[52] U.S. Cl. ..... 439/578; 439/675

[58] Field of Search ..... 439/578–585, 439/675; 874

[56] References Cited

U.S. PATENT DOCUMENTS

| | | | |
|---|---|---|---|
| 2,798,113 | 7/1957 | Koller et al. | 439/585 |
| 2,941,028 | 6/1960 | Edlen et al. | 439/585 |
| 4,755,152 | 7/1988 | Elliot et al. | 439/585 |
| 5,059,139 | 10/1991 | Spinner et al. | 439/578 |

*Primary Examiner*—David L. Pirlot

*Attorney, Agent, or Firm*—Oblon, Spivak, McClelland, Maier & Neustadt

[57] ABSTRACT

A coaxial cable includes a coaxial wire having a central conductor, an outer conductor, an inner insulating layer between said central and outer conductors and an outer insulating layer covering said outer conductor. A hollow metal tube has an inner wall, a first end and a second end which is restricted and press-formed to possess a polygonal wall surface tightly receiving the outer conductor of the coaxial wire when the latter is inserted into the metal tube. The metal tube further has a stop member adjacent to the first end. A plug member is inserted into the first end of the hollow metal tube where the stop member limits the movement of the plug member in the metal tube. The first end of the metal tube is in electrical contact with an annular electric conducting wall of the plug member, and a central electric conducting blade axially extends into the metal tube and electrically contacts the central conductor of the coaxial wire. The second end of the plug member protrudes from the metal tube, and a plastic sleeve is provided around the metal tube.

4 Claims, 2 Drawing Sheets

COAXIAL CABLE

BACKGROUND OF THE INVENTION

1. Field of Invention

The invention relates to a cable, more particularly to a coaxial cable which has a sound electromagnet shielding to prevent interference from outside said coaxial cable.

2. Description of the Related Art

Referring to FIG. 1, a prior art coaxial cable (10) which is used to connect an aerial antenna and a TV includes a central conductor (11) and an outer conductor (13) separated by an insulating material. The central conductor (11) is electrically connected to a central shaft of a plug member (12), and the outer conductor is electrically connected to an annular wall (also an electric conductor) of the plug member. A protective layer (14) is molded on the coaxial cable (10) such that only a section of the plug member (12) by which to connect a TV protrudes from the protective layer (14). A drawback of the above-mentioned coaxial cable is that there is extra expense for making a mold. The protective layer (14) can then only be molded on the coaxial cable (10) and the plug member (12). In addition, the coaxial cable thus produced has poor electromagnetic shielding.

To improve electromagnetic shielding, a new coaxial cable has been invented as shown in FIG. 2. As illustrated, a plastic layer (15) is molded on a section (B) of the coaxial cable. An aluminum foil (16) is manually sleeved on the plastic layer (15) and a plastic protective sleeve (17) is sleeved around the aluminum foil (16). The problem with the above-mentioned coaxial cable is that the process takes a long time, so that thus mass production is slow.

Referring to FIG. 3, a hollow metal tube (18) is substituted for the plastic protective sleeve so as to provide a good electromagnetic shielding. The plug member (12) includes a central shaft (121) and a clamping portion (122) isolated by an insulating layer. The clamping portion (122) of the plug member (12) is inserted through the hollow metal tube (18) to engage the outer conductor of the coaxial wire (10). The clamping portion (122) is pressed inwardly so that the clamping portion (122) engages the outer conductor of the coaxial wire (10). The hollow metal tube is then threaded on the plug member. A drawback of the above-mentioned coaxial cable is that it requires a considerable time to depress the clamping portion inwardly in order to engage the outer conductor (13) of the coaxial wire (10).

SUMMARY OF THE INVENTION

A main object of the present invention is to provide a coaxial cable which is free from the drawbacks described above and which includes a metal tube having a particular structure such that assembly time of the coaxial cable can be reduced when compared to that of the prior art models.

According to the present invention, a coaxial cable for electrically connecting a TV and the like to an aerial antenna includes a coaxial wire having a central conductor, an outer conductor, an inner insulating layer between the central and the outer conductors and an outer insulating layer covering the outer conductor. A section on a first end of the outer insulating material is cut so as to expose the outer conduct and the outer conductor is pulled toward a second end of the outer insulating layer such that the latter covers the first end of the outer insulating layer. A hollow metal tube has an inner wall, a first end and a second end opposite to said first end. The second end of the hollow metal tube is restricted and press-formed to possess a polygonal wall surface for tightly receiving one end of the coaxial wire such that the outer conductor of the coaxial wire is in tight electrical contact with the inner portion of the polygonal surface wall of the hollow metal tube. A plug member has a central blade, an annular wall, a first end and a second end opposite to the first end and is inserted into the first end of the hollow metal tube such that the annular wall of the plug member being in electrical contact with the first end of the hollow metal tube and the central blade of the plug member axially extends into the metal tube and is in electrical contact with the central conductor of the coaxial wire while the first end of the plug member protrudes outside of the metal tube. A plastic sleeve is manually sleeved around the metal tube.

BRIEF DESCRIPTION OF THE DRAWING

Other features and advantages of the present invention will become apparent in the following detailed description, including drawings, all of which show a non-limiting form of the invention and in which.

DETAILED DESCRIPTION OF THE PREFERRED EMBODIMENT

Figure 1:
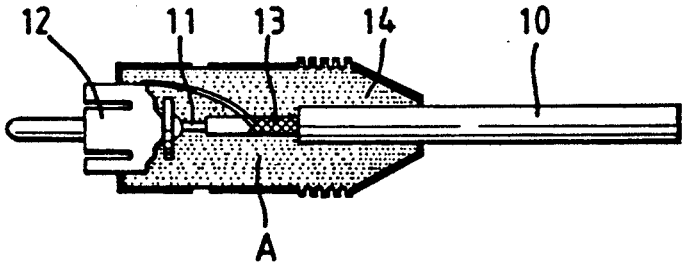
FIG. 1 (PRIOR ART)
FIG. 1 shows a coaxial cable of the prior art.
Figure 2:
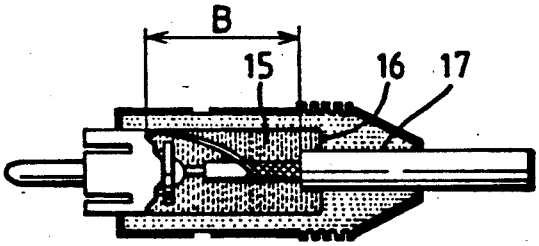
FIG.2 (PRIOR ART)
FIG. 2 shows another kind of coaxial cable of the prior art.
Figure 3:
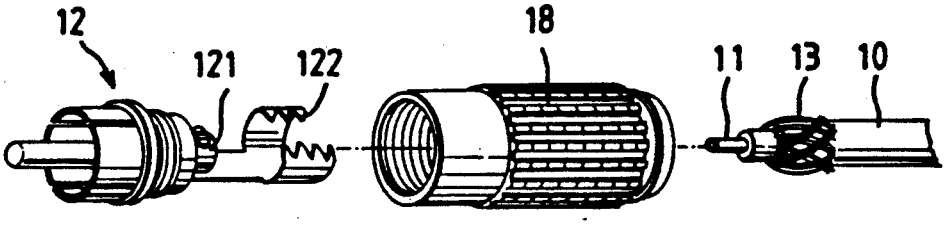
FIG.3 (PRIOR ART)
FIG. 3 shows still another kind of coaxial cable of the prior art.
Figure 4:
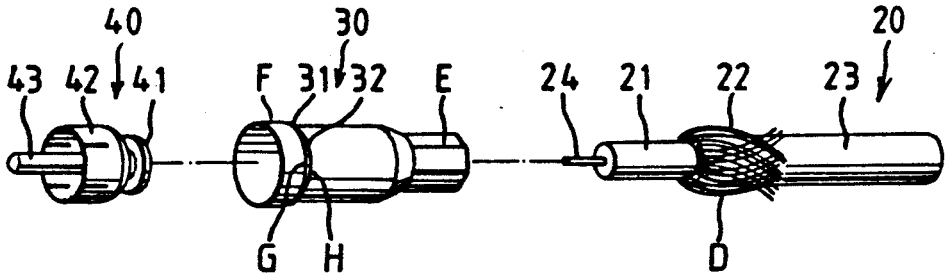
FIG. 4 is an exploded view of a coaxial cable of the present invention shown without a protective sleeve provided thereon.

Referring to FIG. 4, a coaxial cable according to the present invention for connecting a TV and the like to an aerial antenna includes a coaxial wire (20), a hollow metal tube (30), a plug member (40) and a plastic protective sleeve (50).

The coaxial wire (20) includes a central conductor (24), an outer conductor (22), an inner insulating layer (21) between the central conductor and the outer conductor and an outer insulating layer (23) covering the outer conductor. A section on a first end of the outer insulating layer (23) is cut so as to expose the outer conductor ((22) and the outer conductor (22) is pulled to a second end of the outer insulating layer to cover the first end of the outer insulating layer (23), as shown in FIG. 4.

Figure 5:
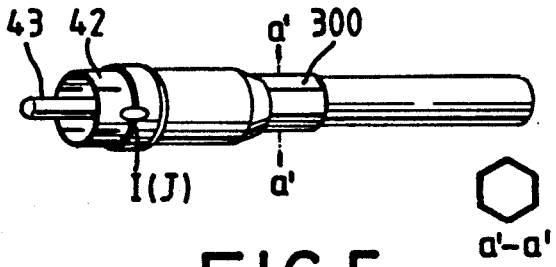
FIG. 5 is an assembled view of a coaxial cable of the present invention shown without a protective sleeve provided thereon.

The hollow metal tube (30) is press-formed and includes an inner wall (32), a first end (E) and a second end (F) opposite to the first end. The first end (E) in the preferred embodiment is restricted by press-forming to have a hexagonal wall surface (300) as shown in FIG. 5.

Figure 7:
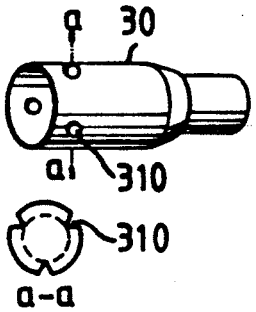
FIG. 7 shows a first preferred embodiment of a metal tube employed in making a coaxial cable of the present invention.
Figure 8:
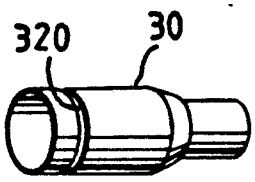
FIG. 8 shows a second preferred embodiment of a metal tube employed in making a coaxial cable of the present invention.

An important thing to note is that the restricted portion thus made tightly receives the rearwardly pulled outer conductor of the coaxial wire (20) when the latter is inserted into the first end (E) of the hollow metal tube (30). The outer conductor (22) of the coaxial wire (20) is electrically connected to the inner portion of the hexagonal wall surface. The second end (F) of the hollow metal tube (30) is gradually decreased inwardly in diameter. A stop member (31) can be provided in the hollow metal tube (30) adjacent to a free end of the second end which limits the movement of a plug member when the latter is inserted into the metal tube (30). The stop member can be an annular ring (320) radially and inwardly projecting from an inner wall of the hollow metal tube (30), as shown in FIG. 8, or it can be a dented portion (a) as shown in FIG. 7, which includes a plurality of protrusions projecting radially and inwardly from an inner wall of the metal tube. Whatever the shape of the stop member, its function is to limit the movement of the plug member and maintain the same at a proper position inserted in the hollow metal tube.

The plug member (40) includes a central electric conducting blade (43), an annular electric wall (42) and an insulating layer separating the central electric conducting blade from the annular electric wall, a first end and a second opposite to the first end. The first end of the plug member (40) is inserted into the second end of the hollow metal tube (30) wherein the stop member (31) keeps the movement of the plug member from moving further into the metal tube (30). Under this condition, the second end of the hollow tube (30) is in electrical contact with the annular electric conducting wall (42) of the plug member (40) while a rear section (41) of the central blade axially extends into the metal tube (30) and is in electrical contact with the central conductor (24) of the coaxial wire (20) and a front section (43) of the second end of the plug member protrudes from the metal tube as shown in FIG. 5. Furthermore, the rim of the metal tube (30) is welded to the annular wall (42) of the plug member at (J) so that the plug member (40) can not be separated even by a violent pull.

Figure 6:
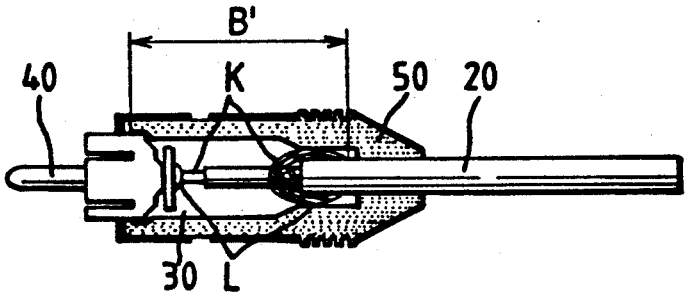
FIG. 6 shows a cross sectional view of a coaxial cable of the present invention.

Finally, a protective plastic sleeve (50) is sleeved around the hollow metal tube as shown in FIG. 6. Under this condition, the section (B') of the coaxial cable possesses a sound electromagnetic shielding better than those shown in the prior art models.

An important thing to note is that since the construction of the coaxial cable of the present invention does not use a mold, the expense of making a mold can be saved. The manufacturing cost can thus be correspondingly reduced. The hollow metal tube (30) is press-formed, which process costs lesser when compared to a molding type or a production by a lathe machine. Since one end of the hollow metal tube is restricted and the remaining end has a stop member therein, the coaxial wire and the plug member can respectively be inserted into two ends of the hollow metal tube without adjusting the alignment of the coaxial wire and the plug member with respect to the metal tube, a continuous process of which during mass production can shorten the manufacturing time. In addition, the present invention does not need a step of depressing the restricted end in order to engage with the outer conductor of the coaxial wire which development can shorten assembly time during mass production.

While a preferred embodiment has been illustrated and described, it will be apparent that many changes and modifications may be made in the general construction and arrangement of the present invention without departing from the spirit and scope thereof. Therefore, it is desired that the present invention be not limited to the exact disclosure but only to the extent of the appended claims.

I claim:

1. A coaxial cable comprising:

a coaxial wire having a central conductor, an outer conductor, an inner insulating layer between said central and outer conductors and an outer insulating layer covering said outer conductor, a section on a first end of said outer insulating layer being cut so as to expose said outer conductor and which is pulled toward a second end of said insulating layer such that said outer conductor covers said first end of said outer insulating layer;

a hollow metal tube having an inner wall, a first end and a second end opposite to said first end, said second end being restricted to possess a polygonal wall surface so as to receive one end of said coaxial wire when said coaxial wire is inserted into said second end of said.hollow metal tube wherein said outer conductor is in tight electrical contact with an inner portion of the polygonal wall surface, said hollow metal tube further having a stop member provided therein adjacent to said first end thereof;

a plug member having a central electric conducting blade, an annular electric conducting wall and an insulating material disposed between said central electric blade and said annular electric conducting wall, a first end and a second end opposite to said first end, said second end is inserted into said first end of said hollow metal tube such that said first and of said hollow metal tube being in electrical contact with said annular electric conducting wall of said plug member and said central electric conducting blade axially extends into said hollow metal tube and is in electrical contact with said central conductor of said coaxial wire while said stop member prevents said plug member from further moving into said metal tube, said first end of said plug member protruding out from said first end of said hollow metal tube, said plug member and said hollow metal tube being welded together; and a plastic sleeve provided around said hollow metal tube.

2. A coaxial cable as claimed in claim 1, wherein said hollow metal tube further includes a neck portion gradually decreasing in diameter from said first end toward an interior thereof, said neck portion serving as said stop member.

3. A coaxial cable as claimed in claim 1, wherein said stop member is a dented portion formed adjacent to said first end thereof and including a plurality of protrusions radially and inwardly projecting from an inner wall of said hollow metal.

4. A coaxial cable as claimed in claim 1, wherein said stop member is an annular ring extending inwardly and radially from an inner wall of said hollow metal tube.

* * * * *